United States Patent [19]

Bornhorst

[11] Patent Number: 4,965,099

[45] Date of Patent: Oct. 23, 1990

[54] APPARATUS AND METHOD FOR SELECTIVELY COATING THE INNER SURFACE OF A HOLLOW BODY

[75] Inventor: James R. Bornhorst, Xenia, Ohio

[73] Assignee: Valco Cincinnati, Inc., Cincinnati, Ohio

[21] Appl. No.: 428,183

[22] Filed: Oct. 27, 1989

[51] Int. Cl.[5] ..... B05D 7/22; B05C 3/02

[52] U.S. Cl. ..... 427/230; 118/408; 118/410; 118/428; 427/238; 427/287; 427/430.1; 427/443.2

[58] Field of Search ..... 427/230, 238, 443.2, 427/430.1, 287; 118/408, 410, 428

[56] References Cited

U.S. PATENT DOCUMENTS

| | | | |
|---|---|---|---|
| 1,621,016 | 3/1927 | Jackson . | |
| 2,067,922 | 1/1937 | Hothersall | 91/68 |
| 2,449,783 | 9/1948 | Laidig et al. | 118/408 |
| 2,692,209 | 10/1954 | Binder | 118/408 |
| 2,731,947 | 1/1956 | Harder | 118/408 |
| 4,842,469 | 6/1989 | Schmidt | 118/410 |

*Primary Examiner*—Janyce Bell

*Attorney, Agent, or Firm*—Frost & Jacobs

[57] ABSTRACT

A fixture for automatically and selectively coating a predetermined area of the inner surface of a hollow body with a liquid, wherein the hollow body has a closed end and an open end with an edge which defines the open end. The fixture is preferably at least partially disposed in a volume of the coating liquid, and comprises a base member, a pressure tube attached to the base member, and in fluid communication with a variable pressure source, and a hollow body support for orienting the hollow body in inverted condition with its open edge partially submerged in the volume of coating liquid. The inverted hollow body thereby provides a closed cavity defined by the closed end of the hollow body and the partially submerged open edge. A preferred embodiment of the fixture further includes a control partition extending upwardly from the base, circumscribing and spaced radially from the pressure tube. The liquid level within the closed cavity formed by the inverted hollow body can hereafter be raised by application of an underpressure to the cavity through the pressure tube, and the uppermost raised level of the liquid is positively limited by the control partition.

27 Claims, 8 Drawing Sheets

APPARATUS AND METHOD FOR SELECTIVELY COATING THE INNER SURFACE OF A HOLLOW BODY

TECHNICAL FIELD

This invention relates to an apparatus and method for automatically and selectively coating predetermined areas of a hollow body, and, more particularly, to a device and method for reliably and accurately applying a uniform coating to selected portions of the inner surface of a hollow body and providing a high quality edge line between the coating and uncoated portions of the hollow body.

BACKGROUND ART

There are many applications in which surfaces of a hollow body are to be coated with material for various reasons. For example, the interior portions of light bulbs or similar lamps must often be coated with various substances to control light rays emitted from the bulb, and hollow body insulators are often coated on their interior surface with similar insulating material or the like. Similarly, various dishes, plates, pans and other items commonly used in the food preparation industry, domestic use, and the like, often require the application of specialized coatings or surface finishes such as non-stick material and the like to various parts of the products.

Methods previously employed to coat the inner surfaces of hollow bodies included dipping the product, or mechanical application of a coating material by a brush or similar applicator devices. Standard dipping procedures, however, inherently coated both the inner surface and the outer surface. Where coating of the outer surface was not desired, dipping procedures required tedious masking procedures or post-dipping removal of the unwanted coating from the outer surfaces.

Similarly, application of coatings to the inner surfaces of hollow bodies by means of brushes or similar mechanical applicator devices required that the interior area of the hollow body be of sufficient size and shape to admit the applicating device and to enable its manipulation therewithin. Such application was inefficient and, in some instances, entirely unworkable due to the size and/or shape of the hollow body to be coated.

Likewise, spraying techniques were insufficient to overcome many of the deficiencies of these previous coating systems, as selective application of the coating was difficult without again involving tedious masking operations or subsequent overspray removal procedures.

One attempt to address the inadequacies of these previous coating methods and apparatuses is set forth in U.S. Pat. No. 1,621,016, which issued Mar. 15, 1927 to R. P. Jackson. The Jackson patent discloses the use of a tank or receptacle filled with liquid to be coated onto the inner surface of a hollow article. The tank has a lid member which is specifically designed to support the hollow body to be coated in an inverted position. A tubular member mounted within the tank has an open upper end located within the interior portions of the inverted hollow body and communicates with a vacuum pump at its distal end. The lid member supports the hollow body such that the surface of the liquid creates a seal around the mouth of the hollow body whereby a vacuum can be created within the hollow body to cause the liquid level therewithin to rise to a predetermined level. Thereafter, the vacuum is removed and the liquid level recedes to its initial position, leaving a coating on the inside surface of the hollow body. The Jackson apparatus and process, however, requires a lid member specifically designed to appropriately support the hollow body to be coated, and a separate lid structure must be provided for each particular product to be coated. Moreover, the rising level of the coating liquid within an inverted hollow body is controlled only by the pressure differential induced by the vacuum tube, making control of the coating process difficult, relatively unreliable, and totally dependent upon accurate control of the vacuum pressure and timing.

A method for coating the interior surface of a can structure is shown in U.S. Pat. No. 2,067,922 which issued Aug. 2, 1934 to J.M. Hothersall. The Hothersall process concerns the coating of can structures which are open at either end, and which can be momentarily sealed within the apparatus to form part of a coating chamber therewithin. A vacuum draws liquid upwardly within the coating chamber and the can, completely filling the can and thereby coating its inner surfaces. Rising fluid within the coating chamber eventually closes off the vacuum source by pushing a flow valve upwardly. The Hothersall process does not provide a viable method for selectively coating the interior surface of an inverted structure such as a pan or cooking utensil, as it relies upon the open-ended nature of the structure to be coated to form part of its coating chamber. Moreover, the Hothersall process is inefficient in that it requires complete filling of its coating chamber, and lacks precise control of what portions of the inner surfaces of a product are to be coated.

U.S. Pat. No. 2,692,209 which issued on Apr. 29, 1953 to A. Binder, Jr., describes a coating process for light bulbs wherein liquid is pulled into the bulb by a vacuum, and the vacuum is shut off when the liquid surface level reaches the desired uppermost height therewithin. The Binder reference also contemplates a need for removing the coating on the lower portions of the bulb where coating material is not desired. Again, the Binder apparatus relies upon precise control of the vacuum or pressure within the item to be coated to limit the surfaces being coated by the rising liquid. This requirement for precise pressure control is unreliable and inefficient, as differences in viscosity of the coating fluid, size and volume of the product being coated, temperature, and similar variables can cause unpredictable variations in the coating procedures. As a result, this process cannot adequately provide positive control of the coating process and precisely uniform results, as is required in many modern-day applications.

Consequently, while coating processes and apparatuses have been widely used for various products through the years, heretofore there has not been available a coating process which could simply, accurately and reliably, automatically and selectively coat a predetermined area of the inner surface of a hollow body. Moreover, there has not been available an apparatus or process which can be easily adapted to a wide variety of shapes and sizes of hollow bodies, and which can selectively coat predetermined areas of the inner surfaces of those hollow bodies with uniform consistency and reliability.

DISCLOSURE OF THE INVENTION

It is an object of the present invention to obviate the above-described problems and shortcomings of the devices and processes heretofore available in the industry for coating predetermined areas of the inner surfaces of a hollow body.

It is another object of the present invention to provide an improved apparatus and process for automatically and selectively coating predetermined surfaces of a hollow body with a liquid.

It is yet another object of the present invention to provide an apparatus and process for selectively coating predetermined areas of the inner surface of a hollow body which can be easily adapted to a variety of shapes and sizes of hollow bodies to be coated.

It is also an object of the present invention to provide an automatic apparatus and process for coating the inner surface of a hollow body which positively controls the selective coating process in a simple and reliable manner.

In accordance with one aspect of the present invention, there is provided an apparatus for automatically and selectively coating a predetermined area of the inner surface of a hollow body with a liquid, wherein the hollow body has a closed end and an open end with an edge which defines the open end. A preferred embodiment of the apparatus includes a fixture at least partially disposed in a volume of the coating liquid, and that fixture comprises a base member, a pressure tube attached to the base member and in fluid communication with a variable pressure source, and a plurality of hollow body supports for orienting the hollow body in inverted condition with its open edge partially submerged in the volume of coating liquid. The inverted hollow body thereby creates a closed cavity defined by the closed end of the hollow body and the partially submerged open edge. The fixture preferably further includes a partition extending upwardly from the base, circumscribing and radially spaced from the pressure tube. The liquid level within the closed cavity formed by the inverted hollow body can thereafter be raised by application of a vacuum to the cavity through the pressure tube, and the uppermost raised level of the liquid is limited by the partition.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
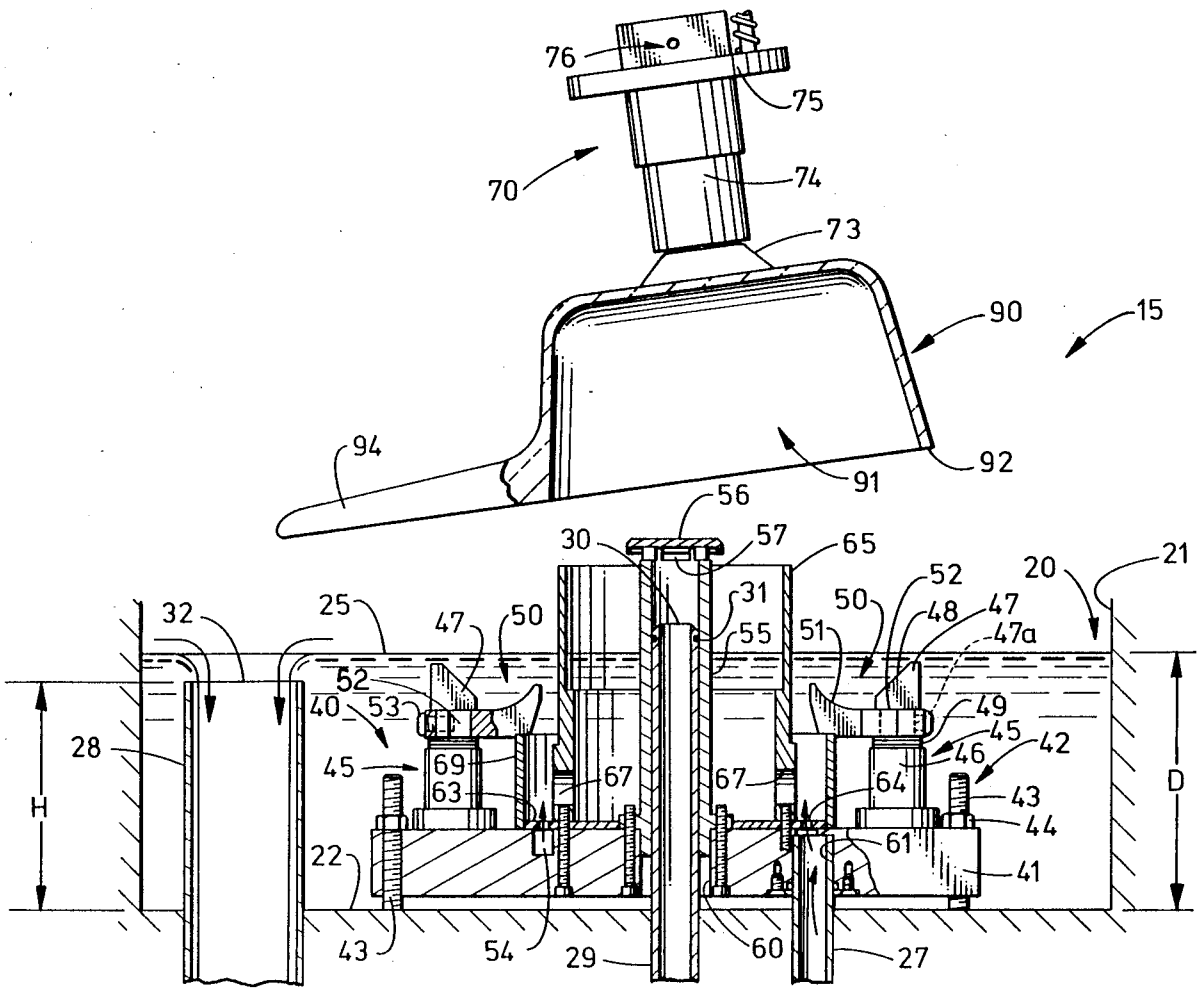
FIG. 1 is a partial cross-sectional view of an apparatus for selectively coating the inner surface of a hollow body made in accordance with the present invention, illustrating a hollow body indexed above a coating fixture.

Referring now to the drawings in detail, wherein like numerals indicate the same elements throughout the views, FIG. 1 illustrates a preferred embodiment of an apparatus 15 for selectively coating the inner surface of a hollow body (e.g. 90). FIG. 1 is presented as a partial cross-sectional view for clarity.

Coating or masking apparatus 15 comprises a masking tank 20 having peripheral sidewalls 21 and bottom wall 22 which form an upwardly facing reservoir or tank for confining a volume of coating material such as K-25 hot melt material available from Evans Manufacturing in Detroit, Michigan. For the purposes of simplicity, the terms "coating" and "masking" shall be understood to be interchangeable herein. Obviously, the material to be coated onto a product may vary between each particular application. Masking tank 20 is provided with one or more inlet tubes 27 for providing a preferably continuous flow of liquid coating material thereinto, and an outlet drain tube 28 extending upwardly from the bottom surface 22 of tank 20. Outlet drain or overflow tube 28 is provided with an open upper edge 32 preferably situated a predetermined height (i.e. H) from bottom surface 22 so as to enable continuous withdrawal of excess liquid coating material (e.g. 25) from tank 20 and to maintain a predetermined depth D of coating material 25 therewithin. It can be seen that the continuous supply of liquid coating material 25 via inlet tube 27 and the continuous withdrawal of liquid 25 via overflow tube 28 provides continuous circulation of the material, and maintains a predetermined depth within tank 20.

One or more masking fixtures 40 is to be situated within masking tank 20. Also extending through bottom wall 22 of tank 20 is an upstanding vent tube 29 preferably having an upper open edge 30 located above the upper surface of the normal level (e.g. depth D) at which liquid material 25 is to be maintained within tank 20. As will be seen, vent tube 29 provides fluid communication with a pressure varying source for operation of masking fixture 40.

Figure 7:
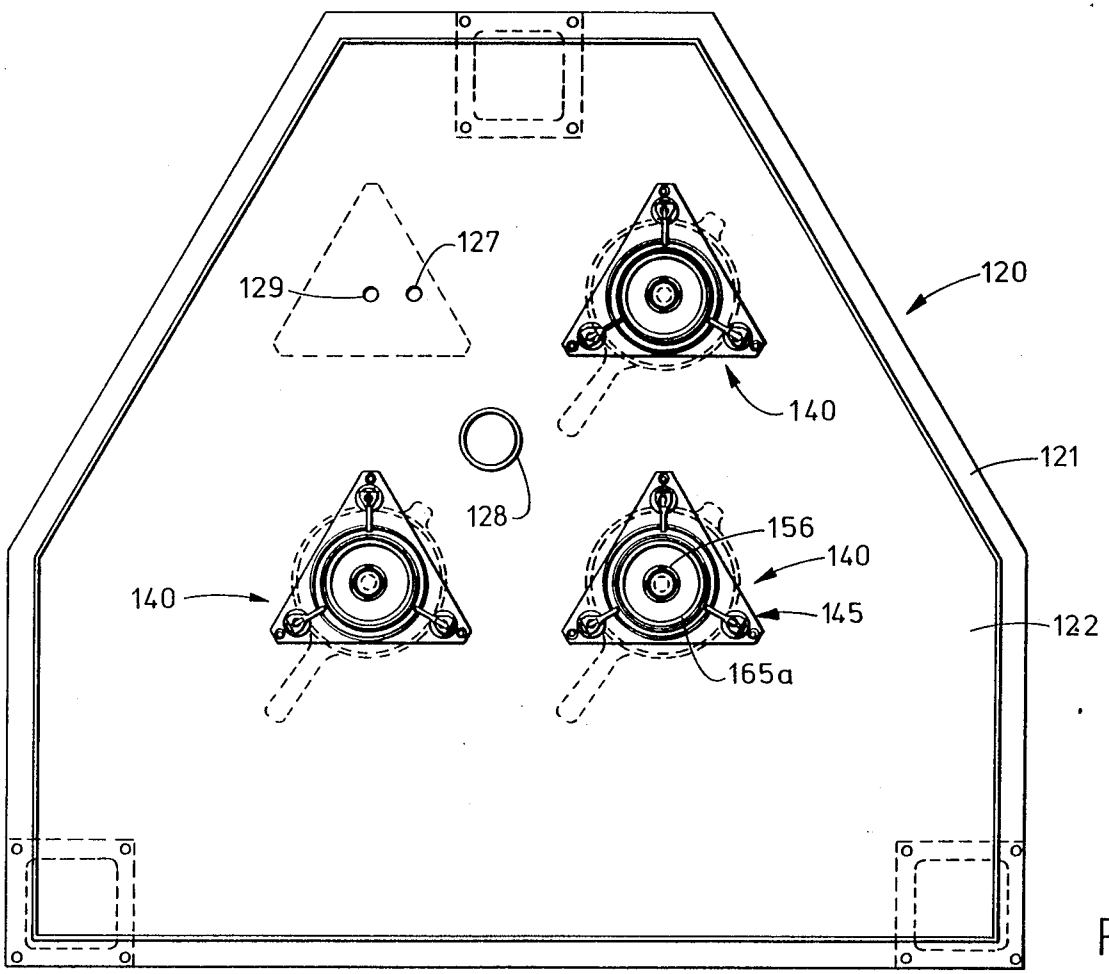
FIG. 7 is a top plan view of a portion of a multi-fixture coating apparatus made in accordance with the subject invention.

A typical fixture 40 is contemplated as including a fixture base 41 to be placed on the upper surface of bottom wall 22 of tank 20 by a plurality of leveling screws 42. Leveling screws 42 are each illustrated as including a threaded leveling pin 43 which is threadedly received within fixture base 41 and extends therethrough to provide an adjustable leveling point. It is contemplated that each fixture 40 would have at least three leveling screws 42 for properly leveling base 41 within tank 20. Once the threaded leveling pin 43 is properly located relative fixture base 41, a lock nut 44 can be tightened into place. Leveling pin 43 can be threadedly received within a threaded aperture through base 41 or within a threaded insert which might be threaded and staked into a bore formed through fixture base 41, as desired. As best illustrated in FIG. 7, it is preferred that fixture base 41 take a triangular conformation for simplicity and economy. Obviously, the shape of base 41, and the structure and number of particular leveling means (e.g. leveling screws 42) is not critical and can be substituted with similar structures as desired.

A bore 60 is preferably formed near the center of fixture base 41, and an upstanding pressure tube 55 is mounted adjacent bore 60, extending upwardly therefrom. Tube 55 can be formed integrally with base 41 or attached thereto in any convenient manner. FIG. 1 illustrates the attachment of pressure tube 55 to base 41 via a bolted flange arrangement. The interior diameter of pressure tube 55 is designed to slidingly telescope over the outer surface of vent tube 29, and a seal is preferably created between these telescoped members, such as by the use of an o-ring seal (e.g. 31). It is further preferred that o-ring seal 31 be located at a position on the outer portions of vent tube 29 above the predetermined normal liquid depth D to be maintained within tank 20.

Because it is contemplated that various coating fixtures 40 can be substituted for one another within tank 20, it is also preferred that the substitution of such fixtures can be accomplished without the requirement of draining the fluid 25 from tank 20. By insuring that the upper edge 30 of vent tube 29, and the sealing means (e.g. o-ring 31), are located above the predetermined depth D of liquid 25 within tank 20, removal of fixture 40 and replacement with a different fixture can be accomplished without draining the liquid from tank 20.

The upper portion of pressure tube 55 is preferably covered by a cover plate 56 to prevent dust, dripping masking material 25 or other foreign material from falling into pressure tube 55 and/or vent tube 29. Immediately below cover plate 56 on the upper edge of pressure tube 55 is formed one or more apertures 57 to provide fluid communication from the interior to the exterior of vent tube 29 and pressure tube 55. It should be understood that pressure tube 55 effectively creates an extension of vent tube 29 by its sealed and telescoped interaction with tube 29.

Circumscribing the periphery of pressure tube 55 is coating overflow tube or control partition 65. Overflow tube 65 preferably features a generally tubular configuration having generally open upper and lower ends, and being attached adjacent its lower end to fixture base 41. As seen best in the plan view of FIG. 7, mask overflow tube (upper edge 165*a* of tube 165 shown in FIG. 7) of the subject invention can preferably be formed as a round tube, especially where the inner surfaces of a product (e.g. 90 of FIG. 1) are also generally round in conformation.

As illustrated in FIG. 1, overflow tube or control partition 65 also preferably includes one or more apertures 67 formed about its lower periphery to provide fluid communication between the inner and outer portions of tube 65 within tank 20. As will be discussed in greater detail below, the number, size and shape of apertures 67 can be designed to provide attenuated flow of liquid material 25 from the outer portions of overflow 65 to the inner portions during masking operations. As also illustrated in FIG. 1, the lower portions of overflow tube 65 may be somewhat thicker than the upper portions to facilitate attachment of tube 65 to base 41 (e.g by screw attachment as shown). As will be discussed below, it is preferred that the thickness of the upper portions of overflow tube 65 be minimized to provide accurate and predictable product cut-off and flow of liquid material 25 thereover during masking operations.

It is preferred that inlet tube 27 be so situated that it can be directly coupled with a corresponding inlet opening 61 formed in the lower portions of fixture 41. It should also be understood that the coupling of inlet 27 with fixture base 41 will ensure a predetermined orientation of masking fixture 40 within tank 20, as fixture 40 must be aligned over both vent tube 29 and inlet tube 27.

As illustrated in FIGS. 1–4, coating operations must often be performed on products which are not symmetrical in design. For example, product 90 is an example of a cooking utensil or similar product having a generally rounded interior volume 91 and upper edge 92, with a handle 94 extending outwardly from a side portion thereof. Consistent orientation of product 90, and its handle 94 in particular, is preferred in a coating process to ensure uniform results. Likewise, proper orientation of masking fixture 40 is also imperative, and the provision of alignment means for masking fixture 40 improves efficiency and quality of the overall procedure. While various alignment pins or the like can be utilized, the provision of inlet tube 27 adjacent vent tube 29 conveniently fills this need. More importantly, however, this preferred connection of inlet 27 to fixture 40 also ensures that fresh liquid material 25 is constantly being provided to critical portions of fixture 40, as will be described below.

FIG. 1 further illustrates fixture base 41 as including an inlet ring or recessed channel 54 in fluid communication with opening 61 and extending around the outer periphery of mask overflow tube 65 within base 41. Overlying base 41 above inlet ring 54 is a dispersion plate 63 formed with a plurality of dispersion holes 64 providing predetermined fluid communication between inlet ring 54 and the area directly above dispersion plate 63. It is contemplated that a plurality of spaced holes 64 would be formed through dispersion plate 63 to direct liquid material 25 from inlet ring 54 upwardly within the volume of liquid product 25 already held within tank 20. Concentrically arranged and spaced outwardly from mask overflow tube 65 is another upwardly extending flow ring 69. It is contemplated that flow ring 69 can be conveniently attached about the outer periphery of dispersion plate 63. Dispersion plate 63 can in turn be anchored to the upper surfaces of fixture base 41 in any convenient manner, such as by placing plate 63 underneath overflow tube 65 prior to its attachment to base 41, as illustrated. Flow ring 69 is designed to help direct liquid material dispersed through holes 64 in a generally upward direction to ensure flow of fresh material 25 to vital areas of the masking fixture 40.

Located about the periphery of fixture 40, and preferably spaced radially outwardly from overflow tube 65, are a plurality of adjustable product supports 45. As seen best in the top plan view of FIG. 7, a preferred arrangement of a masking fixture (e.g. 140) made in accordance herewith comprises three radially spaced adjustable product supports (e.g. 145).

As illustrated in the detail of FIG. 1, each adjustable product support 45 preferably includes a support foot 46 having a flange for attachment to fixture base 41, and an upwardly extending support pin 47. Support pin 47 is preferably of generally round cross-sectional conformation, having a flattened portion 47*a* for alignment purposes. Support pin 47 also has an angular self-leveling locator ramp 48 designed to facilitate centering of a product (e.g. 90) on fixture 40. Adjustably mounted on support pin 47 is an internal locator finger 50 (partially sectioned for clarity) generally comprising a blade-like curved surface 51 attached to a mounting ring 52 designed to encompass support pin 47. Adjustment shims 49 can be slided over support pin 47 prior to sliding mounting ring 52 of locator finger 50 onto support pin 47, thereby vertically locating locator finger 50 as desired. It is contemplated that shims 49 can comprise washers or other similar structures having a predetermined thickness for permitting accurate vertical adjustment of locator finger 50 on support pin 47 as necessary. Once locator finger 50 has been properly vertically adjusted, it can be locked in place, such as by tightening a set screw 53 against the flat 47*a* of support pin 47. The vertical orientation of the locator fingers 50 on a particular fixture 40 will vary between particular applications and products to be coated.

Figure 5:
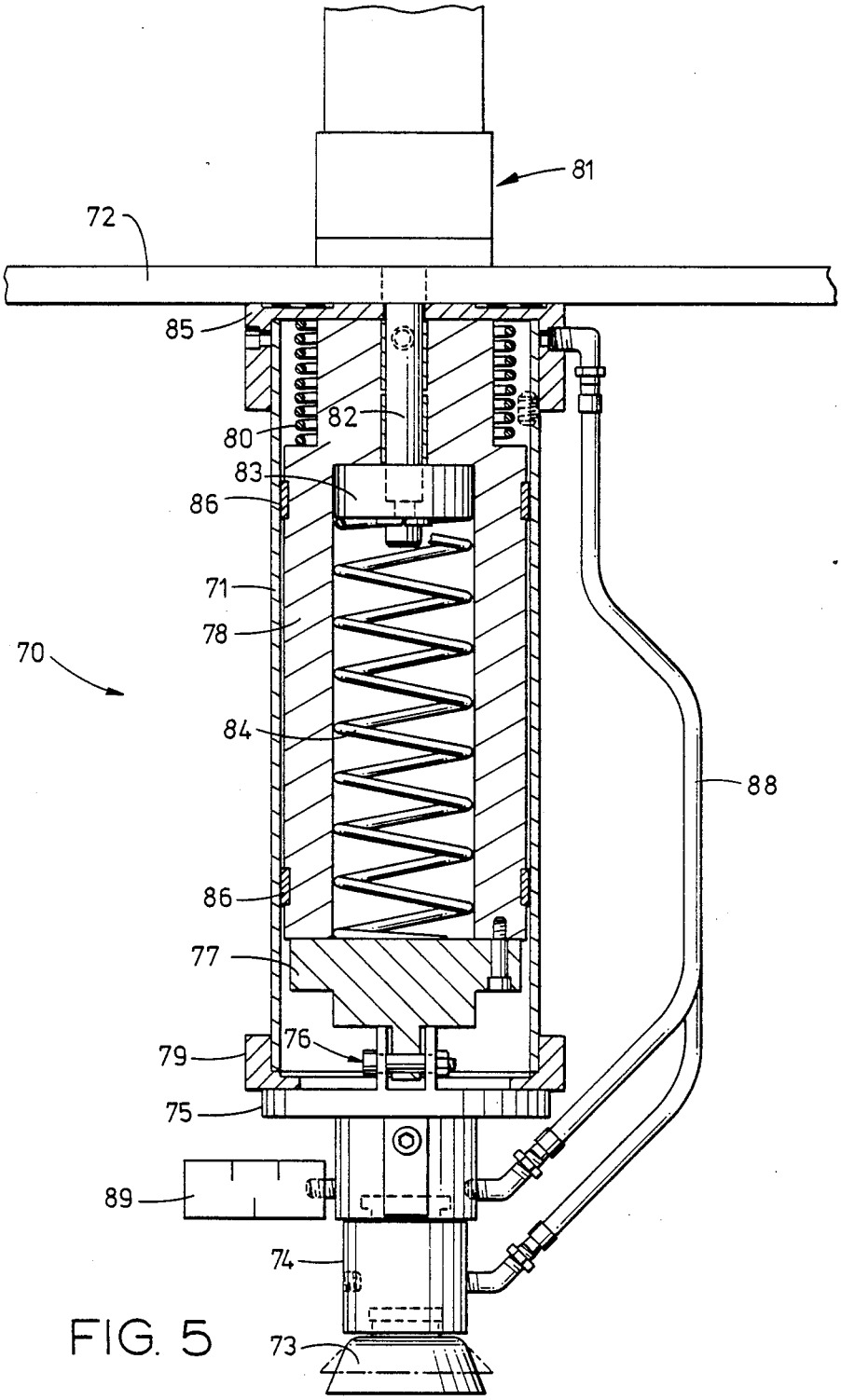
FIG. 5 is a partial, cross-sectional view of a preferred compliance member for transferring a hollow body to be coated.
Figure 6:
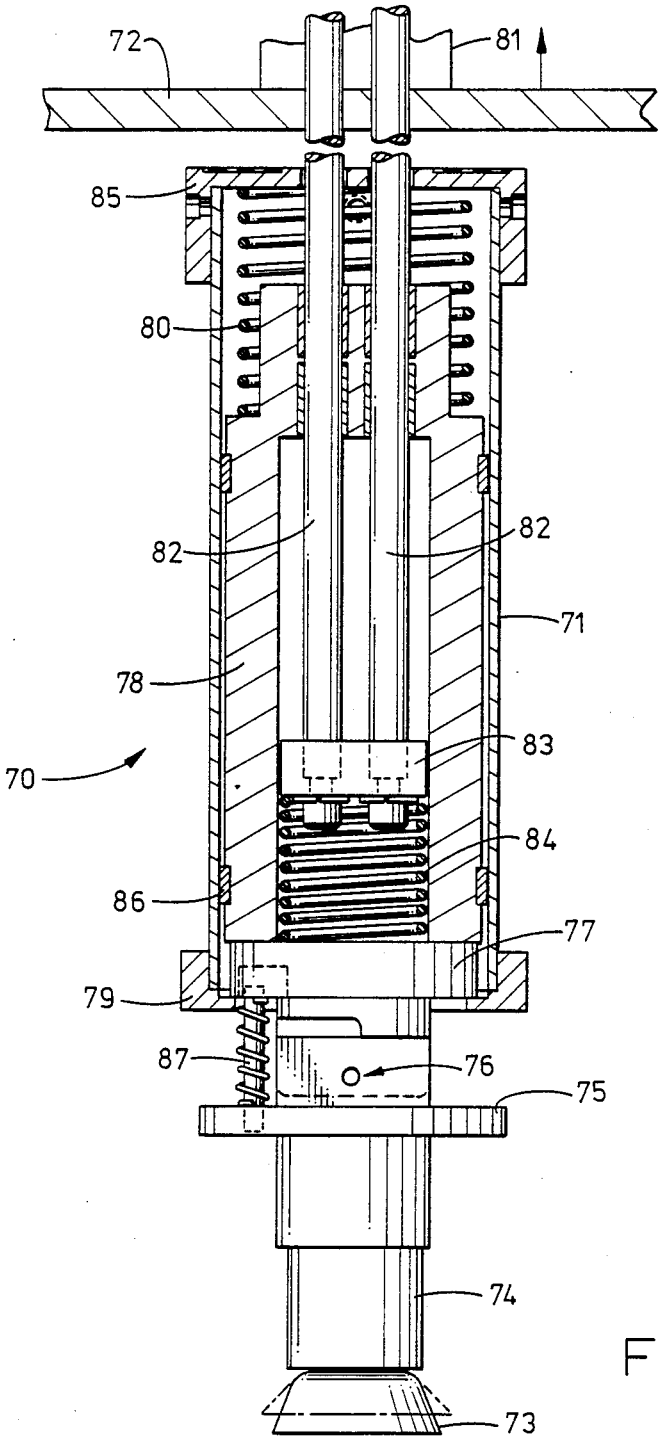
FIG. 6 is a left side, cross-sectional view of the compliance device of FIG. 5, illustrating the fully extended position of the device (with product not shown for simplicity)

Masking apparatus 15 further includes means for manipulating the product (e.g. 90) to be coated, and preferably comprises a compliance device 70 for indexing a product 90 over masking fixture 40, and thereafter lowering product 90 onto fixture 40. A preferred compliance device 70 is illustrated in FIGS. 1, 5 and 6 as including a pliant vacuum cup 73 attached to a vacuum head 74 mounted to a pivot plate 75. Pivot plate 75 is, in turn, attached by a pivot joint 76 to a vertical adjustment means (such as a pneumatic cylinder 81, as best illustrated in FIG. 5) for lowering product 90 onto fixture 40.

Turning now to FIGS. 5 and 6, a preferred compliance device 70 is illustrated as including a cylindrical housing 71 attached at its upper end to a wear plate 85 and at its distal end to a shoulder 79. An extension body 78 is slidably mounted via a pair of wear rings 86 within housing 71 for reciprocating vertical movement in accordance with movement of cylinder rods 82 of pneumatic cylinder 81. As seen in FIG. 6, cylinder 81 is preferably a dual rod type (i.e. two rods 82) to prevent rotation of device 70 and a product 90 supported. Extension body 78 is attached adjacent its lower end to a fulcrum cap 77 which in turn is attached to pivot joint 76, which pivotally mounts vacuum head 74 to fulcrum cap 77 such as in a pinned yoke arrangement, as illustrated. Vacuum head 74 is shown as being attached to a vacuum source via vacuum lines 88. A spring 80 is provided to ensure smooth action of the vertical movement of a product manipulated by compliance device 70.

Extension body 78 is preferably formed with an elongated internal recess wherein a centering disk 83 is slidably located. Centering disk 83 is attached such as by bolts or similar means to the distal ends of cylinder rods 82 of pneumatic cylinder 81. On the downward side of centering disk 83 is located a compression spring 84 designed to absorb excess downward vertical pressure of cylinder 81 and cylinder rods 82 when extension body 78 and a product held by vacuum cup 73 is moved downwardly onto a masking fixture below. In particular, compliance device 70 is preferably designed to implement a full vertical stroke each time it is actuated, and compression spring 84 is included to limit the maximum downward force exerted by compliance device 70 on a product which is placed on a masking fixture in accordance with the present invention. This arrangement also allows compliance device 70 to equally handle products of different heights without a need for adjusting the stroke length.

A compression spring 87 is attached to pivot plate 75 to maintain vacuum head 74 in a substantially vertical orientation, once pivot plate 75 moves downwardly out of contact with shoulder 79 (see FIG. 6), until vacuum cup 73 contacts a product to be picked up. By maintaining vacuum head 74 in a vertical orientation, vacuum cup 73 will be generally located near the center of the closed bottom wall (e.g. 93) of a product to be coated. FIG. 5 illustrates compliance device 70 in its uppermost vertical position, wherein the upper surface of extension body 78 abuts wear plate 85, and pivot plate 75 abuts shoulder 79. This abutting relationship ensures that vacuum head 74 and its attached vacuum cup 73 are oriented vertically and centered within the compliance device 70 for post-masking delivery procedures.

FIG. 6 illustrates compliance device 70 in its fully extended position (product supported by device 70 not shown for simplicity) wherein fulcrum cap 77 has contacted the inner stop portions of shoulder 79, and compression spring 84 has been compressed substantially from its original extended position. It should be understood that spring 80 ensures that pivot plate 75 will be released from its contact with shoulder 79 when rods 82 of cylinder 81 are moved downwardly; and that compression spring 84 allows for pivoting of vacuum cup 73 and its attached product during a substantial portion of the vertical stroke of compliance device 70, while simultaneously limiting the maximum downward vertical pressure exerted by cylinder 81 on a product which has been situated on a masking fixture below. Once spring 80 is fully extended, further downward travel of rods 82 will cause wear plate 85 to separate from mounting plate 72 to enable full extension of device 70. The spring-loaded arrangement also enables the use of oversized cylinders for smoother, more reliable, and more dependable service.

It is also preferred that vacuum head be of the venturi type, including a check valve (not shown) in its upper portion and a second pressure line attached in its lower portion to facilitate release of product 90 from suction cup 73 following masking procedures. Muffler 89 is included to reduce the noise and to attentuate the gas release upon product blow-off or release.

As illustrated in FIG. 1, compliance device 70 and its pivot joint 76 result in handled product 90 being lowered onto a masking fixture 40 in a slightly oblique orientation. In particular, the weight of handle 94 will cause the product to be supported in an angled orientation, and may allow product 90 to swing slightly (dampened by spring 87) as it is lowered into masking tank 20, thereby causing handle 94 to enter the volume of liquid material 25 prior to other portions of product 90. It has been found that such an angular dipping procedure for non-symmetrical products can help avoid the trapping of air under the handle 94 and/or the formation of air bubbles within liquid material 25 of tank 20. It should be noted that air bubbles within coating material 25 can cause non-uniform coating lines or similar inconsistencies in the coating process. As mentioned above, it is often desirable to ensure that a product is coated or masked with a reliably uniform thickness and with a smooth and straight cut-off edge. Entrainment of air within coating material 25 can significantly increase the chances of coating flaws due to air bubbles and the like. The articulated nature of compliance device 70 provides a more gradual entrance of product 90 into the volume of coating material 25, minimizes air entrainment, and allows for additional compliance of product 90 during initial alignment on product supports 45 of fixture 40.

Figure 2:
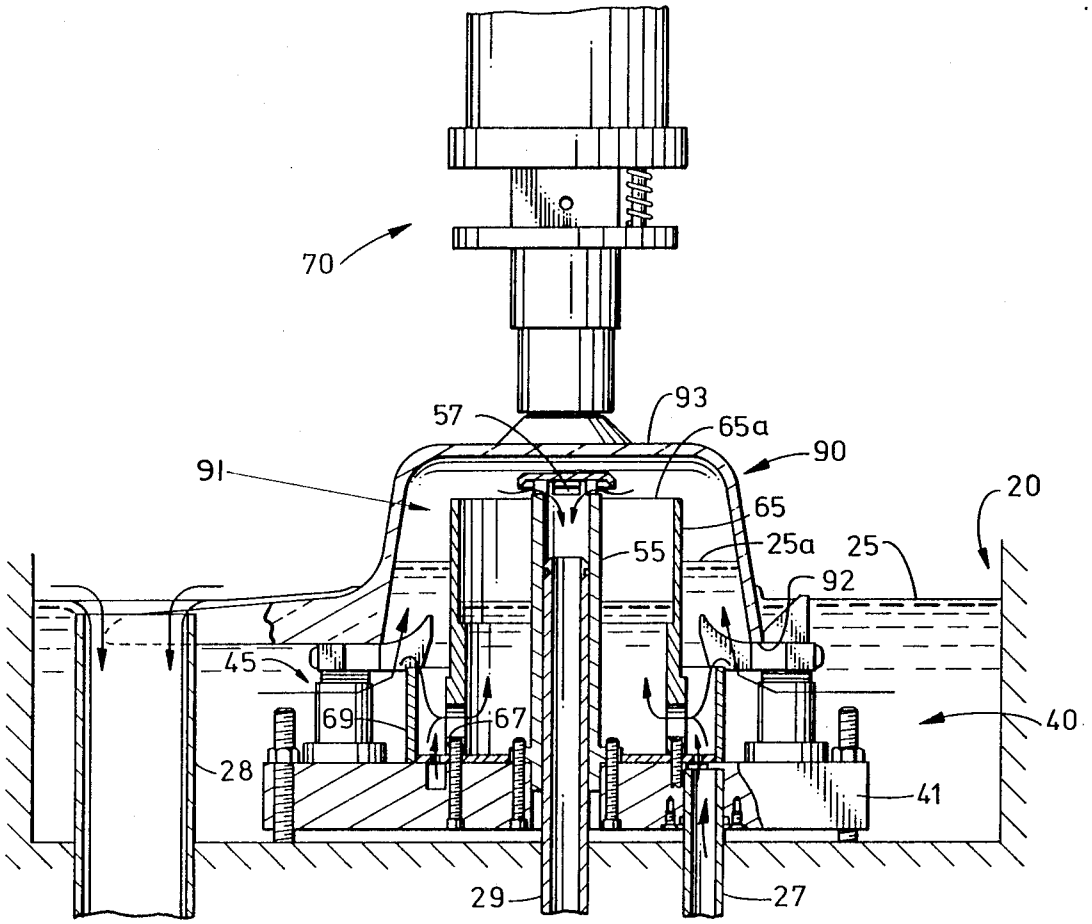
FIG. 2 is a partial cross-sectional view of the apparatus shown in FIG. 1, wherein the hollow body has been lowered onto the coating fixture and a vacuum has been created within the closed cavity of the hollow body.

FIG. 2 illustrates product 90 after it has been completely lowered and aligned on masking fixture 40. As can be understood, as product 90 is lowered, its peripheral edge 92 comes into contact with the self-leveling locator ramps 48 and/or the curved surfaces 51 of locator fingers 50 and is urged into proper alignment on adjustable product supports 45. As indicated in FIG. 2, peripheral edge 92 of products 90 is submerged below the upper surface of liquid 25 in proper position, thereby confining and isolating the interior volume or closed cavity 91 of product 90. As also illustrated in FIG. 2, product supports 45 hold products 90 in proper vertical and horizontal orientation, which is generally and preferably along the center line of compliance device 70 and vent tube 29. As indicated above, compression spring 84 enables full extension of compliance device 70 in a vertically downward direction and permits a predetermined maximum downward pressure on product 90 to effectively hold the same on adjustable product supports 45 as shown.

Once compliance device 70 has been fully extended and product 90 is properly supported on fixture 40, an underpressure or vacuum is applied to the isolated interior volume 91 through vent tube 29. The amount of vacuum necessary for masking operations will, of course, depend upon the particular application variables, including the type and viscosity of material 25 being coated, the size of product 90 to be coated, the cycle times desired for the masking operation, temperature of material 25, and other variables. It has been found that when masking operations are undertaken with molten K-25 hot melt material and at a temperature of about 360° F. (+10° F.) (about 182° C.±6° C.), a vacuum of approximately 2.5 psig is generally sufficient. It has been found that optimum repeatability of masking operations is accomplished if the hot melt material has a consistency similar to water to provide even flow and clean product cut-off.

As illustrated in FIG. 2, as an underpressure is provided within the inverted product 90, liquid material 25 is drawn inwardly and upwardly within the space between mask overflow tube 65 and the inner surfaces of product 90, and the liquid level rises therewithin (e.g. see level 25*a*). It should also be noted that liquid material 25 is also drawn inwardly through holes 67 in the lower portions of overflow tube 65 as a result of the vacuum created. Consequently, it is necessary to design the number and size of holes 67 so as to restrict such inward flow during masking operations to ensure that liquid material 25 flows over the top edge 65*a* of overflow tube 65 from the outside first. It has been found that with fixtures designed for smaller products such as pots and pans, four holes equally spaced about the perimeter of overflow tube 65, each having a diameter of approximately 0.375 inches (about 9.5mm) works well. With larger products and larger diameters of overflow tubes, larger holes can be equally utilized. It should be emphasized that the purpose of holes 67 is to enable liquid 25 which has been drawn into the space within the inner diameter of overflow tube 65 to drain outwardly between masking operations, as will be discussed.

As can be appreciated from the illustration of FIG. 2, fresh liquid material 25 entering through inlet tube 27 will be generally directed upwardly between flow ring 69 and the outer surfaces of overflow tube 65, thereby providing fresh material 25 with a minimum of air entrainment to the most critical areas of the masking fixture.

Figure 3:
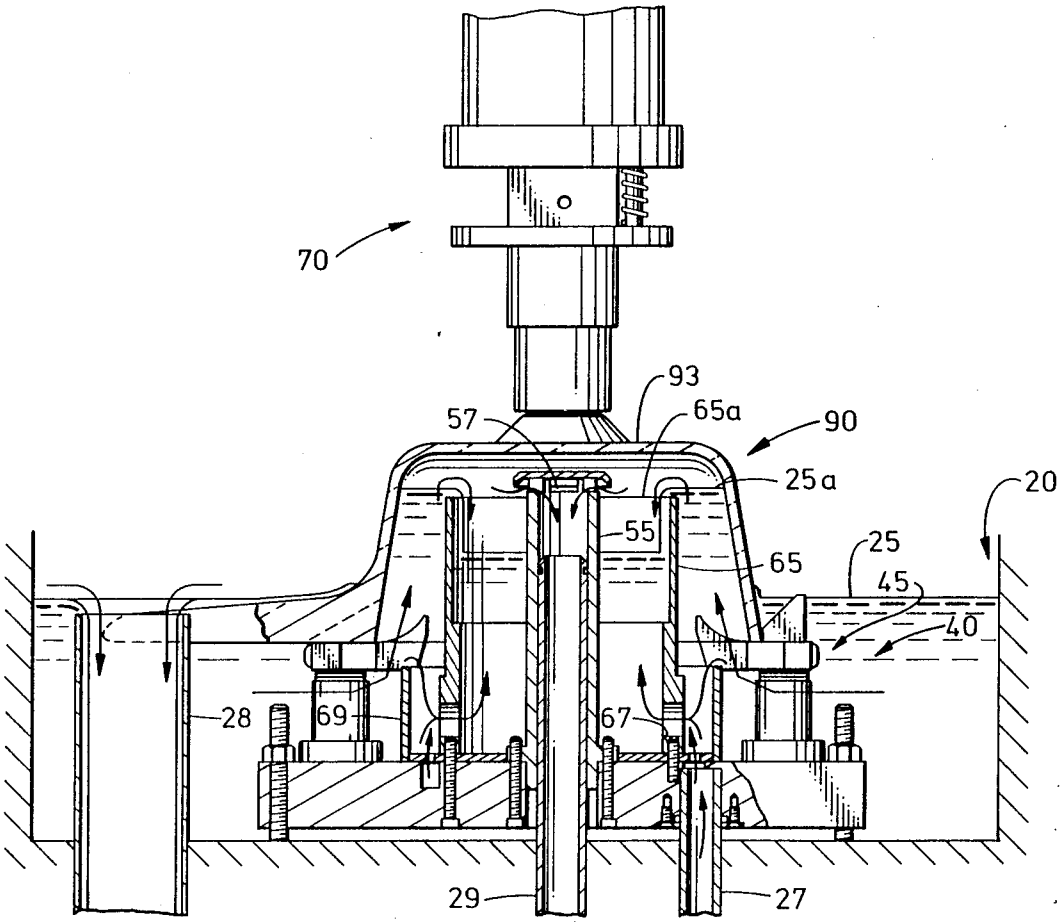
FIG. 3 is a partial cross-sectional view of the apparatus of FIG. 1, illustrating the level limiting characteristics of the overflow tube of the coating fixture.

FIG. 3 illustrates the time during masking procedures when liquid material 25 has risen on the outer periphery of overflow tube 65 to a level (25*a*) such that it begins to overflow into the interior diameter of overflow tube 65. As indicated above, while the liquid level within overflow tube 65 has also been rising during the masking procedure, the rate of the level increase within overflow tube 65 is to be slower than that on the outside thereof. Consequently, overflow tube 65 provides a positive structural limit to the level 25*a* of rising liquid within a product 90, thereby simultaneously precisely controlling the product cut-off line therewithin.

As illustrated in FIG. 3, it is also important to design the length of pressure tube 55 of fixture 40 such that apertures 57 are above the top edge 65*a* of the overflow tube 65 and the corresponding highest level 25*a* to which liquid rises during masking procedures in order to prevent liquid material 25 from flowing into apertures 57, pressure tube 55, and vent tube 29. The dimensions of pressure tube 55 and its cover plate 56 should also be designed to allow clearance between cover plate 56 and the closed bottom wall 93 of product 90 when it is properly located on fixture 40. It has been found that allowing approximately 0.25 inches (about 6.35mm) between the upper surface of cover plate 56 and the inner surface of the closed bottom wall 93 of product 90 is generally sufficient to allow additional shimming of the adjustable product supports 45 to precisely control the product cut-off line achieved during the masking operation without causing interference between cover plate 56 and product 90.

As mentioned above, the number and dimension of drain holes 67 should be coordinated to ensure that during masking procedures the level of liquid material 25 rises most rapidly about the exterior periphery of overflow tube 65. The differential in the rising levels of liquids between the interior and exterior of overflow tube 65 also provides a margin of safety such that precise control and timing of the application of vacuum to the closed cavity 91 is not critical. By increasing the margin of error for masking operations, the present invention simplifies the use of the apparatus and the masking process in general, increases productivity, and minimizes chances for errors.

As illustrated best in FIG. 3, it has been found that as a result of the inherent surface tension of liquid material 25, the material must rise a certain distance above the top 65*a* edge of mask overflow tube 65 before the surface tension is broken and the liquid begins to flow into the interior periphery of overflow tube 65. It has been found that when using K-25 hot melt from Evans Manufacturing at a temperature of approximately 360° F. (+10° F.) (i.e. about 182° C.±6° C.), the upper edge of overflow tube 65 must be situated approximately 0.4375 inches (i.e. approximately 11.1mm) below the desired cut-off line about the inner periphery of product 90. Consequently, when designing fixture 40, the height H of overflow tube 28 (see FIG. 1) must be determined in accordance with the depth of product 90, the desired coating or masking product cut-off line on the interior surfaces of product 90, the relative mounting height of product 90 on the adjustable product supports 45, and the inherent capillary action of the particular coating material 25 being utilized. It has also been found that minimizing the thickness of top edge 65*a* helps to provide more reliable material overflow and masking cut-off.

Once liquid product 25 has been pulled upwardly about the outer periphery of overflow tube 65 as shown in FIG. 3, the underpressure or vacuum created through tube 29 can be terminated.

Upon termination of the vacuum, the closed cavity 91 of product 90 is subjected to atmospheric pressure, thereby tending to force the liquid levels therewithin in a downward direction. The liquid masking material 25 flows outwardly from within the interior 91 of product 90 past the product supports 45 and through the holes 67 in the lower portions of overflow tube 65. It is important to note that holes 67 ensure that the level of coating product 25 within overflow tube 65 drains down to correspond substantially with the depth D within masking tank 20 between successive coating operations, thereby Preventing an accumulation of material 25 within overflow tube 65 which could adversely effect the positive product coating cut-off features of overflow tube 65.

As mentioned, holes 67 are designed to allow limited flow of coating material 25 inwardly during the coating operations, but the more important function of holes 67 is to drain liquid from within overflow tube 65 between successive masking operations. It is contemplated that drain holes 67 could be substituted with mechanical valves or one-way valves to allow only flow of material outwardly from within overflow tube 65 between masking cycles, however, for simplicity of structure and operation, it is preferred to provide holes 67 as described.

Figure 4:
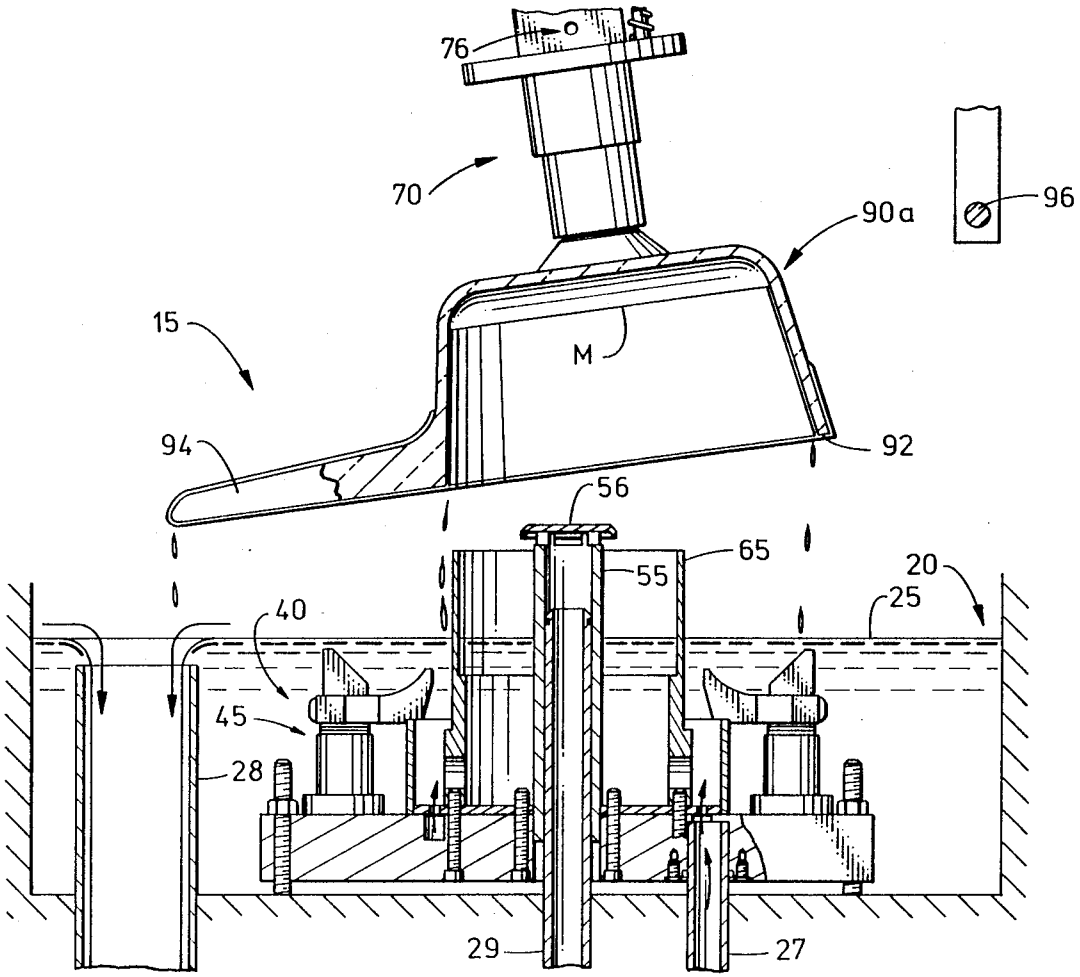
FIG. 4 is a partial cross-sectional view of the apparatus of FIG. 1, illustrating the apparatus following removal of a coated hollow body from the coating fixture.

FIG. 4 illustrates masking apparatus 15 following the masking procedure. Once the underpressure or vacuum has been terminated, and the liquid level has begun to recede within closed cavity 91 of product 90, the now-coated product **90*a* can be lifted upwardly and removed from fixture 40. As illustrated in FIG. 4, it is preferred that as compliance device 70 lifts the coated product 90*a* from fixture 40, pivot joint 76 once again allow articulation of the vacuum head and product 90*a*. In particular, in applications where product 90 includes a handle (e.g. 94), pivot joint 76 enables the weight of handle 94 to slightly skew masked product 90*a* from a horizontal position as it is extracted from tank 20**.

It has been found that a slight skew in orientation facilitates withdrawal of the coated product **90*a* from the volume of liquid 25 while minimizing the creation of turbulence within tank 20 or splashing of liquid material 25 as the peripheral edge 92 of product 90*a* breaks contact with the surface of liquid material 25. It is desirable to minimize the agitation imposed by removing coated product 90*a* from tank 20, as any such mixing can cause entrainment of air within liquid material 25 which can adversely effect the uniformity and overall quality of product masking performed by apparatus 15. It may also be desirable to impose a slight overpressure (e.g. 1–30 psig) within closed cavity 91 once coating has been completed to speed up the lowering of the liquid level (e.g. 25*a*) within cavity 91, and to help release edge 92 from the surface tension of liquid material 25 during removal of product 90*a* from fixture 40**.

As indicated, product **90*a* will have a thin layer coating of material within its interior surfaces and about its outer lower periphery as a result of the coating procedures described above, with an interior masking cut-off line M formed by the rising liquid material 25. It has been found that the product cut-off line indicated at M resulting from coating procedures accomplished with the present apparatus is reliably uniform, straight, and clean, and its location can be accurately insured as a result of proper adjustment of supports 45 and the positive limitation of the rising liquid level provided by control partition 65**.

As also illustrated in FIG. 4, some excess liquid product will inherently drip from the coated product **90*a* as it is lifted from the upper surface of liquid material 25 in tank 20. As can be appreciated, cover plate 56 serves to prevent dripping liquid material from entering pressure tube 55 and vent tube 29. It has been found that drips falling into the liquid volume in tank 20 can also entrain some air within liquid material 25. As described above, fresh liquid material 25 is constantly being supplied to tank 20 via inlet tube 27. Liquid product 25 supplied through inlet 27 is evenly distributed about the outer periphery of overflow tube 65 as a result of dispersion plate 63, dispersion holes 64 and flow ring 69. By ensuring that fresh product is supplied adjacent the outer periphery of overflow tube 65, the present invention tends to move any liquid material 25 with air entrained in an upward and outward direction away from fixture 40 In this way, there is less chance for air bubbles to be present in the liquid material 25 which will actually coat the interior surfaces of a subsequent product 90**.

As described above, compliance device 70 includes a shoulder 79 against which pivot plate 75 abuts when in retracted position. As a coated product **90*a* is removed from tank 20, pivot plate 75 eventually comes into contact with shoulder 79, thereby again aligning product 90*a* in a substantially horizontal orientation. Once the coated product has been aligned in the substantially horizontal position, it is contemplated that it will be indexed to another processing position, such as to enable completion of the hardening of its coating material or the like. Depending upon the viscosity and type of coating material used, often long strings of partially hardened coating material will depend from the lower edges (e.g. 92) of the coated product. It is preferred that this excess material be removed prior to further processing of product 90*a*. It is contemplated that as the coated product 90*a* is indexed from above masking tank 20 to another position, such excess product can be removed by passing product 90*a* over a thin cut-off wire (e.g. wire 96 shown in FIG. 4). This removed excess material can drop directly back into tank 20, or, more preferably, into a recycling bin for reheating and subsequent supply back to tank 20 via one of the inlet tubes. As the coated product 90*a* is indexed from above fixture 40, a subsequent product 90 can be indexed over fixture 40** for coating procedures, as described above.

The subject coating apparatus can also be combined in a multi-fixture arrangement as illustrated in FIG. 7 for increased productivity. In particular, FIG. 7 illustrates a masking tank 120 designed to accommodate four masking or coating fixtures 140, and having a central outlet drain tube 128. One of the fixtures 140 has been removed to illustrate the arrangement of the central vent tube 129 and the inlet tube 127 which will preferably be provided for each particular fixture 140. As described above, the subject masking system is designed for convenient interchangeability of fixtures of various sizes and shapes which need merely be aligned and inserted over auxiliary inlets 127 and central vent tube 129.

It is contemplated that four corresponding compliance devices as described and illustrated herein would be used to simultaneously index four products onto fixtures 140 in a manner similar to that described with regard to FIGS. 1–6. Tank 120 has been illustrated as having an overall size and shape which can easily be adapted as one station of a multi-station processing assembly such as a circular carousel manufacturing line. The size and shape of any particular tank made in accordance herewith will obviously vary according to particular application parameters, and is not critical.

Figure 8:
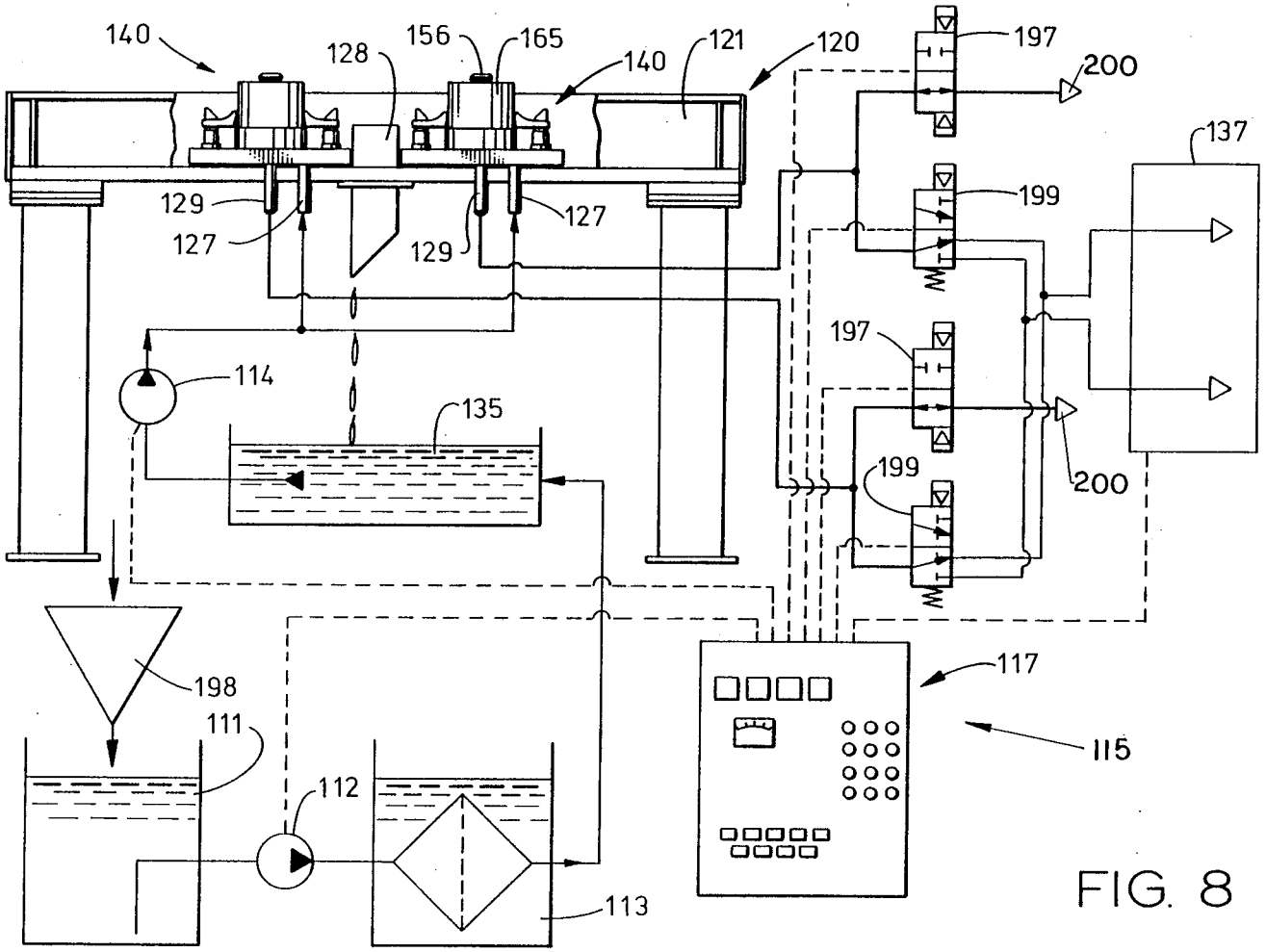
FIG. 8 is a partially broken-out schematic front view of the multi-fixture apparatus of FIG. 7.

FIG. 8 illustrates a schematic front view of the multi-fixture arrangement of FIG. 7, with the front sidewall 121 of tank 120 being partially broken away to illustrate the detail of several fixtures 140 and the outlet drain tube 128 within tank 120. As illustrated, a source of pressure variation 137 is provided and placed in fluid communication with the central vent tubes 129 of tank 120. As mentioned, it is contemplated that variable pressure source 137 would most preferably have the capability of selectively providing positive or negative pressure through vent tubes 129 to fixtures 140. Positive pressure might be used, for example, to minimize cycle times of the apparatus and to facilitate removal of a coated product from the coating fixture.

It is contemplated that masking fixtures 140 can be independently controlled by a programmable controller (e.g. 117) through control valves such as illustrated at 197 and 199. In particular, control valve 197 is preferably a two-way valve which can be either set in the open condition to atmospheric pressure, or set in a closed condition depending upon whether underpressure or positive pressure is desired in the fixture. Valve 199 is preferably a three-way control valve to appropriately provide underpressure or positive pressure to vent tube 129 of a particular fixture 140. Preferably each fixture 140 would have a separate pair of control valves (e.g. 197 and 199), and by coordinating the action of these two valves, a particular fixture 140 will be provided with positive pressure, negative pressure, or atmospheric pressure, as desired. In the normal or at-rest condition, the venting valve (i.e. control valve 197) is open to atmospheric pressure (as indicated at 200) and the vent tube 129 of a particular fixture 140 will experience atmospheric pressure regardless of the position of the pressure valve (i.e. control valve 199). When venting valve 197 is closed, either negative or positive pressure can then be selected through pressure valve 199.

A coating material circulation reservoir 135 is illustrated as being in fluid communication with inlet tubes 127, as well as outlet drain 128. Reservoir 135 continuously circulates liquid material 125 (e.g. molten hot melt or other coating material) to and from tank 120 via pump 114. It is also contemplated that recycling of coating material, as well as the addition of new coating material to reservoir 135, can be accomplished to supplement material which has been removed from tank 120 during the coating procedures. As illustrated in FIG. 8, coating material may be recycled through recycle inlet 198, with such material (as in the case of a hot melt coating material) being heated to a desired temperature in melter 111. The heated material is then pumped via pump 112 to a filtering device 113 to remove any contaminants prior to being directed into circulation reservoir 135. It should also be understood that additional new coating material can similarly be added through inlet 198 to augment the volume of material within circulation reservoir 135. The liquid material is then supplied to masking tank 120 as described above through variable output pump 114, which can be adjusted to provide the desired flow of material through masking apparatus 115. It has been found that a maximum flow of about 6 gallons per minute (about 22.8 liters per minute) is sufficient for a masking apparatus having four fixtures therein.

Liquid level probes (not shown) might also be included within tank 120 to precisely monitor the liquid level therewithin. As mentioned, a control apparatus 117 is illustrated for supervising the overall operation of masking apparatus 115. Control 117 might preferably be a programmable controller for overseeing all of the operations of the masking apparatus 115, including the indexing and operation of the compliance devices utilized to move products through the system, operation and timing of control valves, and control of coating material pumps to maintain proper circulation and liquid levels within the system.

It is contemplated that the present masking apparatus can be utilized to coat particular portions of products, such as for masking products which are to be further processed or coated in the non-masked areas. For example, cooking utensils are often coated only on selected interior areas with non-stick coatings and the like. As described above, the present apparatus and method can be utilized to reliably and uniformly enable the accurate masking of portions of the interior surfaces of a product, ensuring a smooth straight product cut-off line. It has also been found that by utilizing hot melt materials, a removable mask can be applied to a product prior to additional finishing procedures, and, after completion of those additional procedures, the mask can be removed and recycled into the subject masking apparatus. As set forth above, the apparatus and process of the present invention can be easily and quickly adapted to varying shapes and sizes of products, and the product cut-off line can be easily adjusted as appropriate.

Having shown and described the preferred embodiments of the present invention, further adaptions of the coating apparatus and method described herein can be accomplished by appropriate modifications by one of ordinary skill in the art without departing from the scope of the present invention. Several of the potential modifications have been mentioned, and others will be apparent to those skilled in the art. Accordingly, the scope of the present invention should be considered in terms of the following claims and is understood not to be limited to the details of structure and operation shown and described in the specification and drawings.

I claim:

1. An apparatus for automatically and selectively coating an area of the inner surface of a hollow body with a liquid, said hollow body having a closed end and an open end with an edge defining that open end, said apparatus comprising:

a coating tank for containing a volume of coating liquid at a predetermined liquid level;

means for supporting an inverted hollow body such that its open edge is partially submerged in said volume of coating liquid to thereby provide a closed cavity within the closed end of said inverted hollow body and above the level of said liquid;

a vent tube having first and second ends, said vent tube being in fluid communication with a variable pressure source adjacent its first end, and being disposed within said tank such that its second end can be in fluid communication with said closed cavity of a supported inverted hollow body; and a coating control partition substantially circumscribing said vent tube and having a top edge, said partition disposed within said tank and extending upwardly above said liquid level such that said top edge is within said closed cavity, whereby the liquid level within said closed cavity can be raised by creation of an underpressure therewithin, said liquid level within said closed cavity rising until it flows over said top edge of said control partition, whereby the rising level of such liquid is effectively positively controlled by said partition.

2. The apparatus of claim 1, further comprising means for locating an inverted hollow body on said supporting means.

3. The apparatus of claim 2, wherein said locating means further comprises a compliance device for locating a hollow body on said supporting means and for removing the hollow body following coating procedures, said compliance device having a pivot means for permitting articulation of said device and a hollow body being located by said device to facilitate locating and removal procedures.

4. The apparatus of claim 1, wherein said means for supporting a hollow body further comprises a fixture, said fixture having a base, a pressure tube which can be situated in fluid communication with said vent tube, and including said means for supporting a hollow body and said coating control partition, said partition substantially circumscribing said pressure tube and extending upwardly from adjacent said base.

5. The apparatus of claim 4, wherein said pressure tube extends upwardly from adjacent said base and is designed to sealingly engage said vent tube.

6. The apparatus of claim 1, wherein said means for supporting an inverted hollow body comprises a fixture assembly which carries said coating control partition, and wherein said fixture assembly is interchangeable such that it can be removed from said tank for substitution by a similar fixture assembly designed to support a hollow body of different configuration.

7. The apparatus of claim 1, wherein said means for supporting an inverted hollow body includes a plurality of adjustable product supports, said supports spaced about the periphery of said control partition.

8. The apparatus of claim 7, wherein said product supports each comprise means for aligning an inverted hollow body about the periphery of said control partition, and adjustable means for orienting the open edge of said hollow body on a substantially horizontal plane.

9. An apparatus for coating selected portions of the inner surface of a hollow body having a closed end and an open edge, said apparatus comprising:

a reservoir for containing liquid to be coated onto said hollow body, said liquid having an upper surface level;

a vent tube having in fluid communication with a variable pressure source;

a fixture at least partially disposed in said reservoir, said fixture further comprising a pressure tube in fluid communication with said vent tube, means for supporting a hollow body to be coated such that the open edge of said hollow body is below said surface level thereby creating a closed cavity within said hollow body and such that said pressure tube is in fluid communication with said closed cavity, and an upstanding control partition circumscribing and spaced radially outwardly from said pressure tube;

whereby the level of said liquid within a hollow body supported on said fixture can be raised by creation of an underpressure within said closed cavity to coat the inner surfaces of said hollow body with said liquid, and wherein said control partition Provides an effective upper limit to the rising level of said liquid within said hollow body.

10. The apparatus of claim 9, wherein said pressure tube is located radially within said control partition, and wherein said supporting means also serve to center the closed cavity of said hollow body to be coated over said pressure tube and control partition.

11. The apparatus of claim 9, wherein said control partition has a top edge having a height, and wherein rising of the liquid level about the outer periphery of said control partition within said closed cavity will cause liquid to flow over said top edge once the level of liquid rises to said height, thereby effectively providing a structural limitation to the uppermost level of said liquid between said partition and the inner surface of said inverted hollow body.

12. The apparatus of claim 11, wherein said partition further comprises a drain to permit liquid which has flowed over its top edge to drain from within said partition after coating of a hollow body has been completed.

13. The apparatus of claim 9, wherein said fixture further comprises a base upon which said pressure tube, control partition, and supporting means are mounted, said base further comprising means for removably mounting said fixture within said reservoir.

14. The apparatus of claim 9, said apparatus further comprising inlet means within said reservoir for providing a source of liquid to be coated onto the inner surface of a hollow body and for distributing said liquid in an upward direction about the outer periphery of said control partition.

15. The apparatus of claim 14, wherein said inlet means further comprises an inlet tube attached to said fixture and a dispersion channel in said fixture for distributing said liquid about the outer periphery of said control partition.

16. The apparatus of claim 15, said fixture further comprising an upstanding flow ring substantially circumscribing and radially spaced from said control partition for directing said liquid to critical areas of said fixture.

17. The apparatus of claim 9, wherein said supporting means includes a plurality of adjustable product supports spaced about the outer periphery of said control partition.

18. The apparatus of claim 17, wherein said product supports further comprise means for automatically centering said hollow body relative said control partition.

19. The apparatus of claim 18, wherein said means for automatically centering the hollow body includes at least one product centering surface oriented at an angle relative the horizontal for guiding the open edge of said hollow body to proper position.

20. An apparatus for automatically and selectively coating portions of a hollow body having a closed end and an open edge, said apparatus comprising:

a reservoir for containing a volume of liquid to be coated onto said hollow body, said volume of liquid having a normal level;

inlet means for providing liquid to said reservoir, and outlet means for draining excess liquid from said reservoir;

a vent tube having an upper end and being in fluid communication with a variable pressure source, the upper end of said vent tube located above said normal level of said liquid;

a coating fixture at least partially disposed within said reservoir, said fixture comprising a base, a pressure tube which can be attached in fluid communication with said vent tube, a coating control partition circumscribing and spaced radially outwardly from said vent tube and having an upper Peripheral edge, a plurality of adjustable product supports spaced about the outer periphery of said control partition for supporting an inverted hollow body such that its open edge is partially submerged in said volume of liquid to thereby provide a closed cavity within said closed end of the hollow body above said normal level, and means for dispersing liquid product about the outer periphery of said control partition;

whereby the level of said liquid within the closed cavity can be raised by application of an underpressure to said closed cavity via said vent tube and pressure tube, the liquid level rising within said cavity about the outer periphery of said control partition until such rising liquid level overflows the upper peripheral edge of said control partition, said partition thereby effectively positively limiting the uppermost liquid level adjacent said hollow body during coating procedures.

21. The apparatus of claim 20, wherein said means for dispersing liquid product includes a dispersing channel, a dispersion plate having a plurality of dispersion holes located adjacent the outer periphery of said control partition, and a flow ring substantially circumscribing and spaced radially outwardly from said control partition to help direct the liquid product to critical areas of said apparatus.

22. A fixture for use in an apparatus for automatically and selectively coating an area of the inner surface of a hollow body with a liquid, said hollow body having a closed end and an open end with an edge defining that open end, said fixture designed to be at least partially disposed in a volume of the coating liquid, said volume of liquid having a normal level, and said fixture comprising:

a base member;

a pressure tube attached to said base member;

means for supporting an inverted hollow body such that its open edge is partially submerged in said volume of coating liquid to thereby provide a closed cavity within said closed end of said hollow body and above the upper surface of said liquid; and a control partition extending upwardly from adjacent said base and substantially circumscribing said pressure tube, said partition being radially spaced from said pressure tube;

whereby the liquid level within the closed cavity formed by a hollow body supported on said fixture can be raised by application of an underpressure to said cavity through said pressure tube, and the uppermost raised level of such liquid will be effectively limited by said partition.

23. The fixture of claim 22, wherein said supporting means further comprises a plurality of adjustable product supports spaced about the outer periphery of said control partition.

24. A method for automatically and selectively coating portions of the inner surface of a hollow body having a closed end and an open edge, said method comprising the following steps:

supporting a hollow body in inverted condition on a coating fixture disposed at least partially in a coating reservoir containing a volume of coating liquid having a liquid level, such that the open edge of said hollow body is partially submerged in said volume of liquid to thereby provide a closed cavity within the closed end of said inverted hollow body, said fixture having a coating control partition having a top edge extending upwardly above said liquid level; creating an underpressure within said closed cavity to thereby raise the level of said liquid within said closed cavity and on the outer perimeter of said control partition;

maintaining the underpressure within said closed cavity until the level of said liquid rises above said top edge of said control partition and begins to flow inwardly over said top edge;

removing the underpressure from within said closed cavity, thereby permitting the liquid to recede to its level; and removing the coated hollow body from the coating fixture.

25. The method of claim 24, further comprising the step of continuously providing additional coating liquid to the reservoir and continuously removing excess liquid from said reservoir to provide fresh liquid while maintaining said liquid

26. The method of claim 24, further comprising the step of creating a slight overpressure in said closed cavity following removal of the underpressure to minimize the time needed for the liquid to recede to its level.

27. The method of claim 25, further comprising the step of directing fresh coating liquid specifically to the coating fixture and dispersing such fresh liquid about the outer periphery of said control partition to ensure that fresh coating liquid is directed to critical areas during the coating procedures.

* * * * *

UNITED STATES PATENT AND TRADEMARK OFFICE

CERTIFICATE OF CORRECTION

PATENT NO. : 4,965,099

DATED : October 23, 1990

INVENTOR(S) : James R. Bornhorst

It is certified that error appears in the above-identified patent and that said Letters Patent is hereby corrected as shown below:

Claim 1 - Line 56 - Column 14 - "predetermined" should be deleted

Claim 9 - Line 5 - Column 16 - "Provides" should read -provides-

Claim 20 - Line 10 - Column 17 - "Peripheral" should read -peripheral-

Claim 24 - Line 26 - Column 18 - "creating an underpressure within said closed cavity to thereby raise the level of said liquid within said closed cavity and on the outer perimeter of said control partition;" should be a new subparagraph Claim 25 - Line 43 - Column 18 - add to the end of the line -level.-

Signed and Sealed this

Third Day of March, 1992

*Attest:*

HARRY F. MANBECK, JR.

*Attesting Officer*

*Commissioner of Patents and Trademarks*